US005112239A

United States Patent [19]

Yagi et al.

[11] Patent Number: 5,112,239

[45] Date of Patent: May 12, 1992

[54] ELECTRICAL CONNECTOR

[75] Inventors: Sakai Yagi; Masanori Tsuji, both of Shizuoka, Japan

[73] Assignee: Yazaki Corporation, Japan

[21] Appl. No.: 740,907

[22] Filed: Aug. 6, 1991

[30] Foreign Application Priority Data

Aug. 7, 1990 [JP] Japan ..... 2-83087[U]

[51] Int. Cl.[5] ..... H01R 31/08; H01R 4/24

[52] U.S. Cl. ..... 439/189; 439/511; 439/49

[58] Field of Search ..... 439/49, 189, 507, 511, 439/512

[56] References Cited

U.S. PATENT DOCUMENTS

| | | | |
|---|---|---|---|
| 3,871,728 | 3/1975 | Goodman | 439/49 |
| 4,871,324 | 10/1989 | Brune et al. | 439/189 |
| 4,952,155 | 8/1990 | Kuzuno et al. | 439/507 |
| 4,997,390 | 3/1991 | Scholz et al. | 439/511 |
| 5,000,699 | 3/1991 | Nadin | 439/49 |
| 5,061,196 | 10/1991 | Weston et al. | 439/189 |

FOREIGN PATENT DOCUMENTS 61-277180 12/1986 Japan .

*Primary Examiner*—Paula A. Bradley

*Attorney, Agent, or Firm*—Wigman & Cohen

[57] ABSTRACT

An improved electrical connector is described herein. The electrical connector includes a male connector member and a female connector member to be fitted to the male connector member. The male connector member includes an intermediate connector section and a joint connector section both having a plurality of electrical terminals therein. The female connector member also includes an intermediate connector section having a plurality of electrical terminals therein and a joint connector section having no electrical terminals therein, in which the electrical terminals in the intermediate connector section of the female connector member are adapted to be connected to the terminals in the intermediate connector section of the male connector member to establish electrical connection between these terminals when the male and female connector members are fitted together. The electrical connector further includes a joint member for establishing electrical connection among at least two of the terminals in the second section of the first connector member. The joint member is adapted to be removably fitted to the at least two electrical terminals of the second section of the first connector member and to achieve electrical connection therebetween through the connecting member when the joint member is fitted thereto.

4 Claims, 4 Drawing Sheets

ELECTRICAL CONNECTOR

BACKGROUND OF THE INVENTION

1. Field of the Invention

This invention relates to an electrical connector, and in particular to an improved electrical connector having functions not only as a joint connector which connects a main wire connected to a connector member of the connector to other wires also connected to the same connector member in parallel for constituting a branch circuit, but also as an intermediate connector which connects a plurality of wires connected to one connector member of the connector to a plurality of wires connected to the other connector member in series.

2. Description of the Prior Art

A conventional joint connector is disclosed for example in Japanese Laid-Open Patent Publication No. 61-277180, which is shown in FIGS. 1 and 2.

The known joint connector 1 comprises a connecting housing 3 and a male connector member 5 to be fitted into the connecting housing 3. The connecting housing 3 has a base portion 3*a* and a cylindrical hood portion 3*b* extending from the base portion 3*a* so as to define a hollow space 3*c* and a front opening 3*d*. In the base portion 3*a* of the connecting housing 3, there are embedded a plurality of flat male terminals 7 in such a manner that they are protruded into the hollow space 3*c*. These male terminals 7 are divided into some joint terminals 7*a* in which some male terminals are joined together at base parts thereof so as to establish electrical connection among them. Namely, as shown in FIG. 1, there are some joint terminals 7*a* in the connecting housing 3, each of which has two or three male terminals, respectively.

The male connector member 5 includes a plurality of female terminals (not shown) to which a plurality of wires 9 are connected, respectively. The female terminals are arranged so as to receive the male terminals 7 of the connecting housing 3 therein when the male connector member 5 is inserted into the hollow space 3*c* from the front opening 3*d* and then fitted to the connecting housing 3. When the connector member 5 is properly fitted to the connecting housing 3, some of the female terminals attached to the wires 9 will be electrically connected with each other through the joint terminal having the male terminals connected to the female terminals. This means that one of these wires 9, which is designated as a main wire, can be branched to the remaining wires 9 at the joint connector 1 by means of the joint terminal 7*a*. In this case, the number of the wires to be branched at the joint connector 1 depends on the number of the male terminals 7 which constitute the joint terminal 7*a*. Namely, as shown in FIG. 1, if the joint terminal 7*a* has three male terminals, two wires can be branched from the main wire at the joint connector 1. The joint connector 1 can provide a reliable branch circuit, so that it is commonly used in wiring in an automobile or the like.

On the other hand, a conventional intermediate connector generally comprises a female connector member including a plurality of terminals connected to wires and a male connector member including a plurality of terminals connected to wires. The male connector member is constituted so as to be fittable into the female connector member, and to establish electrical connection between the wires in series when the terminals of the connector members are connected together.

In these conventional joint and intermediate connectors, each of the connectors has only one function as a joint connector or an intermediate connector, respectively. Therefore, the conventional joint connector can not be used as an intermediate connector and the conventional intermediate connector can not be used as a joint connector. As a result, in the recent complicated wiring for example wiring harness for use in an automobile, if it becomes necessary to constitute a branch circuit at the junction points of the intermediate connector, a joint connector having the structure as described above has to be additionally prepared. On the other hand, if it becomes necessary to connect wires connected to the male connector member of the conventional joint connector to other wires in series, an additional intermediate connector has to be prepared. This means that the number of connectors used in the wiring has to be increased, thus leading to cost-up in manufacturing thereof.

Further, as stated in the above the number of the branch wires produced by the conventional joint connector depends on the number of the male terminals of the joint terminal which has already embedded in the base portion 3*a* of the connecting housing 3. Therefore, the degree of freedom for connecting arbitrary wires for a branch circuit is restricted by the number and arrangement of the terminals of the joint terminal which has already been embedded in the base portion 3*a*. In order to overcome the problem, it may be possible to prepare a number of connecting housings each having different joint terminals. However, this will result in increasing the manufacturing cost thereof.

SUMMARY OF THE INVENTION

In view of the above inconvenience in the known connectors, an object of the present invention is to provide an improved electrical connector which can be used not only as a joint connector but also as an intermediate connector.

In order to achieve the above object, the improved electrical connector according to the present invention comprises a first connector member and a second connector member adapted to be fitted to the first connector member. The first connector member includes first and second sections both having a plurality of electrical terminals therein. The second connector member also includes a first section having a plurality of electrical terminals therein and a second section having no electrical terminals therein, in which the electrical terminals in the first section of the second connector member are adapted to connect to the terminals in the first section of the first connector member to establish electrical connection between these terminals when the first and second connector members are fitted together. The electrical connector of the present invention further includes a joint member for establishing electrical connection among at least two of the terminals in the second section of the first connector member. The joint member is adapted to be removably fitted to the at least two electrical terminals of the second section of the first connector member and to achieve electrical connection therebetween through the connecting member when the joint member is fitted thereto.

Preferably, the first connector member is formed into a male connector member and the second connector member is formed into a female connector member having a hood portion containing the first and second section of the second connector member.

According to the electrical connector having the above structure, wires connected to the terminals in the first section of the male connector member are connected to wires connected to the terminals in the first section of the female connector member 15 in series, while wires connected to the terminals in the second section of the male connector member are connected in parallel with each other by means of the joint member. Therefore, the electrical connector according to the present invention can have functions as an intermediate connector and a joint connector.

The electrical connector according to this embodiment has the above structure and functions. Therefore, if the connector is used in a junction point in wiring where not only series connection between the wires but also multiple connection among some of the wires are required, the requirement can be satisfied by a single connector. Therefore, it becomes possible to reduce number of the connectors used in the wiring, such as a wiring harness used in an automobile. Further, as stated in the above, according to the electrical connector of the present invention, by preparing different joint members, it becomes possible to provide different multiple electrical connections in the joint connector sections of the connector. Therefore, according to the electrical connector of this embodiment, the degree of freedom in designing branch circuits will be remarkably increased in comparison with the conventional one.

The operation and other advantages of the present invention will become more clear upon reading the following detailed description of the preferred embodiment in conjunction with the accompanying drawings.

DETAILED DESCRIPTION OF THE PREFERRED EMBODIMENTS

Referring now to the accompanying drawings, a preferred embodiment according to the present invention will be explained.

Figure 1:
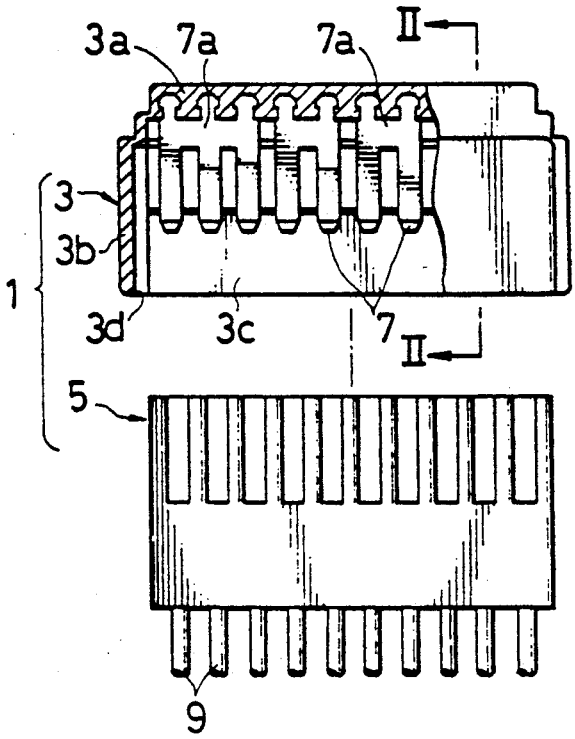
FIG.1 PRIOR ART
FIG. 1 a top plan view showing a known joint connector having a connecting housing and a male connector member to be fitted to the connecting housing.
Figure 2:
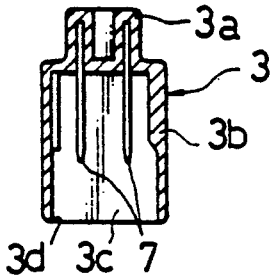
FIG.2 PRIOR ART
FIG. 2 is a sectional view of the connecting housing of the known joint connector, along a line II—II in FIG. 1.
Figure 3:
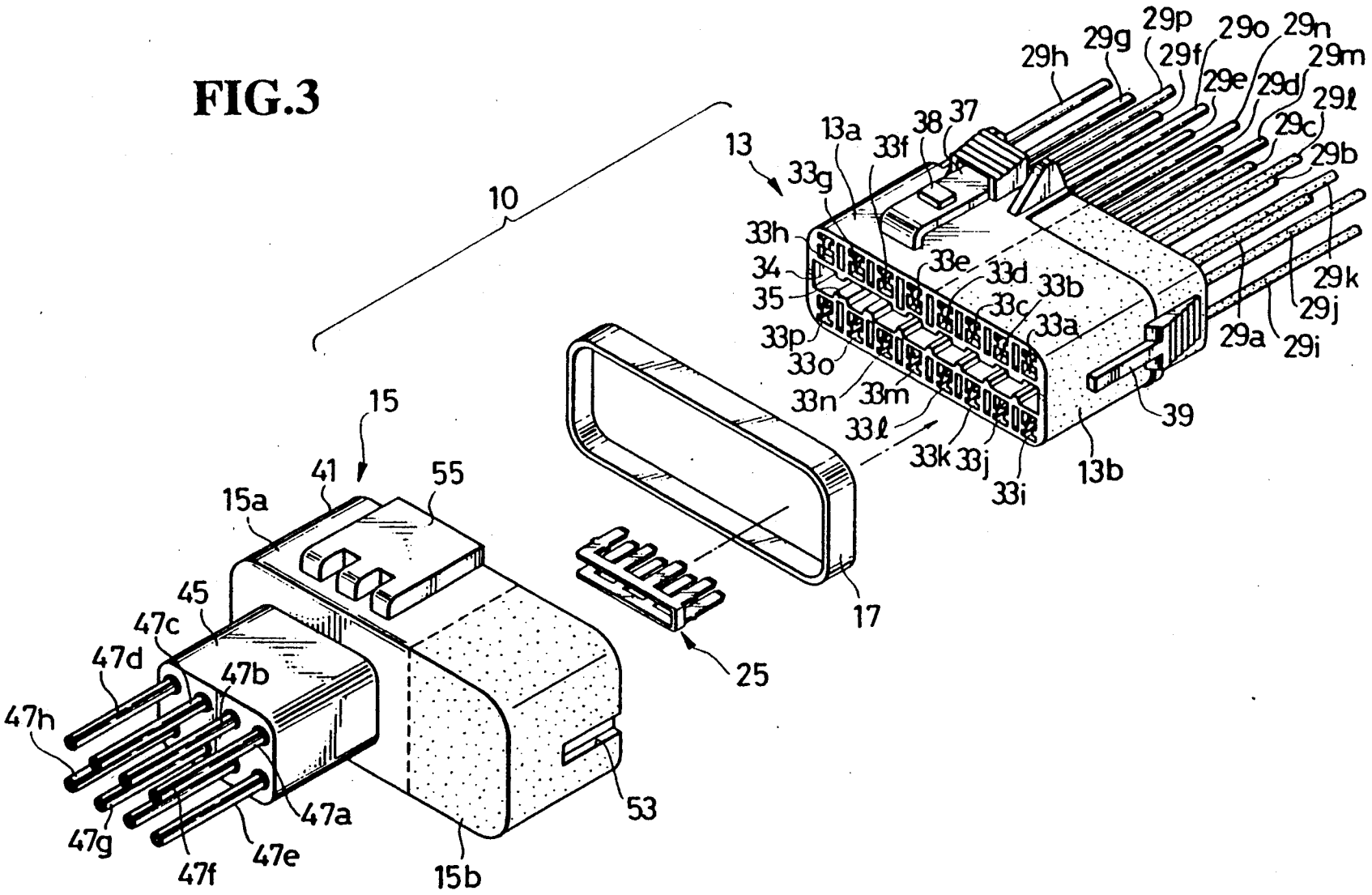
FIG. 3 is a perspective view of an embodiment of an improved electrical connector according to the present invention.

In FIG. 3, the reference numeral 10 designates an improved electrical connector according to the present invention. The electrical connector 10 comprises a male connector member 13 and a female connector member 15 to which the male connector member 13 is fitted. The reference numeral 17 denotes a seal member which will be inserted between the male and female connector members 13, 15 when they are fitted together, to seal therebetween.

As shown in FIG. 3, the male connector member 13 which is formed of a resin material is formed into a substantially flattened box-like shape. In the male connector member 13, there are defined a plurality of cavities each of which extends from the rear end of the connector member 13 to the front end thereof. Specifically, sixteen cavities 33 (33*a* to 33*p*) are arranged in upper and lower rows, in which each row includes eight cavities. In these cavities 33, female terminals 31 (31*a* to 31*p*) which are connected to wires 29*a* to 29*p* are accommodated. Between the upper and the lower rows of the cavities 33, there is defined a space 34. Further, there area plurality of ribs 35 which are partially protruded into the space 34 from the under side of the upper row and the upper side of the lower row of the cavities. Each of the ribs 35 extends along the elongated direction of the male connector member 13.

In this embodiment, eight cavities arranged in the left-hand side in the drawing, that is the cavities 33*e*, 33*f*, 33*g*, 33*h*, 33*m*, 33*n*, 33*o* and 33*p* serve as an intermediate connector, and eight cavities arranged in the right-hand side in the drawing, that is the cavities 33*a*, 33*b*, 33*c*, 33*d*, 33*i*, 33*j*, 33*k* and 33*l* serve as a joint connector. Namely, the male connector member 13 includes an intermediate connector section 13*a* including the cavities 33*e*, 33*f*, 33*g*, 33*h*, 33*m*, 33*n*, 33*o* and 33*p*, and a joint connector section 13*b* including the cavities 33*a*, 33*b*, 33*c*, 33*d*, 33*i*, 33*j*, 33*k* and 33*l*.

On the upper surface of the intermediate section 13*a*, there is provided a latching lever 37 having a latching projection 38. Further, on the side surface of the joint connector section 13*b*, there is formed a guide member 39.

In FIG. 3, the reference numeral 25 denotes a joint member for electrically connecting some desired female terminals among the female terminals 31 accommodated in the cavities of the joint connector section 13*b* for constituting a branch circuit among the wires connected to the desired terminals.

Figure 4:
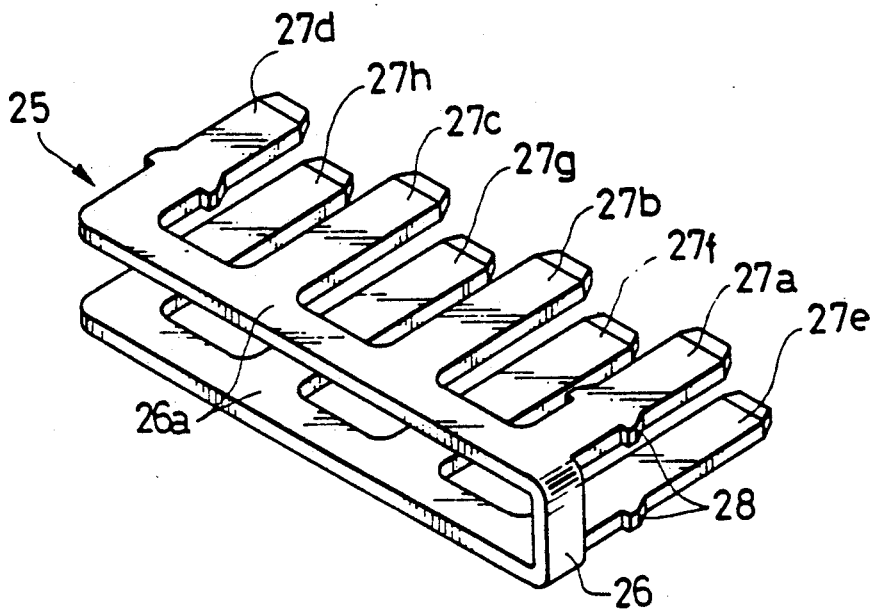
FIG. 4 is a perspective view showing a connecting member used in the connector of this embodiment.

As clearly shown in FIG. 4, the joint member 25 includes a C-shaped base portion 26 having two leg parts 26*a*. Each of the leg parts 26*a* has four flat tabs 27 (27*a* to 27*h*) integrally formed thereon so as to establish electrical connection among these tabs though the base portion 26. Some of these tabs have securing projections 28 for preventing it from being fallen off. These tabs are arranged so as to correspond to the arrangement of the female terminals 31 in the cavities 33*a*, 33*b*, 33*c*, 33*d*, 33*i*, 33*j*, 33*k* and 33*l* of the joint connector section 13*b* of the male connector member 13. The joint member 25 having the above structure is preferably formed by punching a metal strip so as to have the eight tabs 27*a* to 27*b* and the base portion 26 and then bending it into the C-shaped configuration as shown in the drawing. In this regard, it should be noted that the number of the tabs of the joint member can be changed as necessity.

Referring now back to FIG. 3, in the drawing there is also shown the female connector member 15 which is fittable to the male connector member 13. The female connector member 15 comprises a laterally extended hood portion 41 which has the size and configuration into which the front portion of the male connector member 13 is received. The hood portion 41 also includes an intermediate connector section 15*a* (in the drawing, the left-hand side thereof) and a joint connector section 15b (right-hand side thereof), which are arranged so as to mate with the corresponding sections 13a, 13b of the male connector member 13, respectively, when these connector members 13, 15 are joint together.

At the rear surface of the intermediate connector section 15a of the female connector 15, there is a base section 45 in which a plurality of cavities (44 in FIG. 6), preferably eight cavities are arranged in upper and lower rows, each includes four cavities. The arrangement of the cavities are corresponding to the arrangement of the cavities of the intermediate connector section 13a of the male connector member 13. In these cavities, there are accommodated a plurality of male terminals (46 in FIG. 6), preferably eight terminals in such a manner that tip parts thereof are protruded into the intermediate connector section 15a of the hood portion 41 of the female connector member 15. These male terminals 46 are arranged so as to correspond to the female terminals 31 in the intermediate connector section of the male connector member 13. Therefore, the male terminals of the joint connector section 15a of the female connector member 15 will be inserted into the female terminals 31 in the intermediate connector section 13a of the male connector member 13 to achieve electrical connection therebetween. Wires 47 (47a to 47h) are connected to the male terminals in the intermediate connector section 15a of the female connector member 15.

In the joint connector section 15b of the female connector member 15, there are provided no terminals.

On the upper surface of the intermediate connector section 15a of the hood portion 41 of the female connector 15, there is provided a latched member 55 which is engageable with the latching projection 38 of the latching member 37 of the male connector member 13. Further, on the side surface of the joint connector section 15b of the female connector member 15, there is formed a recess 53 into which the guide member 39 of the male connector member 13 is received when the connector members 13, 15 are fitted together.

The improved electrical connector according to this embodiment will be used as follows.

First, the joint member 25 having the eight tabs 27 is mounted to the joint connector section 13b of the male connector member 13 such that the tabs 27a to 27h are fitted into the female terminals 31 in the cavities 33a, 33b, 33c, 33d, 33i, 33j, 33k and 36l of the joint connector section 13b of the male connector member 13. Then, the male connector member 13 is fitted into the female connector member 15 in such a manner that the female terminals 31 in the cavities 33e, 33f, 33g, 33h, 33m, 33n, 33o and 33p of the intermediate connector section 13a of the male connector member 13 are fitted to the male terminals in the intermediate connector section 15a of the female connector member 15.

In this fitting condition, the joint connector sections 13b, 15b and the intermediate connector sections 13a, 15a of the male and female connector members 13, 15 are connected as follows.

Figure 5:
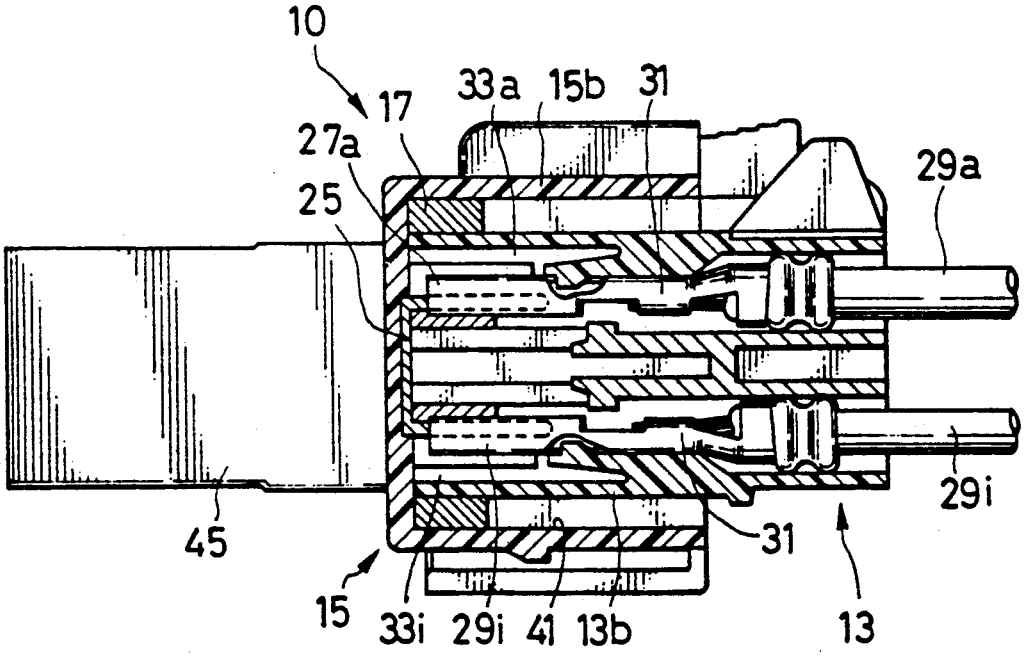
FIG. 5 is a cross sectional view showing the condition that the connector of this embodiment is actually used, in which it shows a portion where the connector is used as a joint connector.

Namely, as shown in FIG. 5, the female terminals 31 in the joint connector section 13b of the male connector member 13 are electrically connected with each other through the joint member 25, thus resulting in establishing electrical connection among the wires 29a, 29b, 29c, 29d, 29i, 29j, 29k and 29l to which the females terminals are connected. Therefore, if one of these wires 29 is designated as a main wire through which electricity is supplied, the electricity will be supplied to the other wires through the joint member 25, which constitutes a branch circuit and therefore can provide a function as a joint connector.

Figure 6:
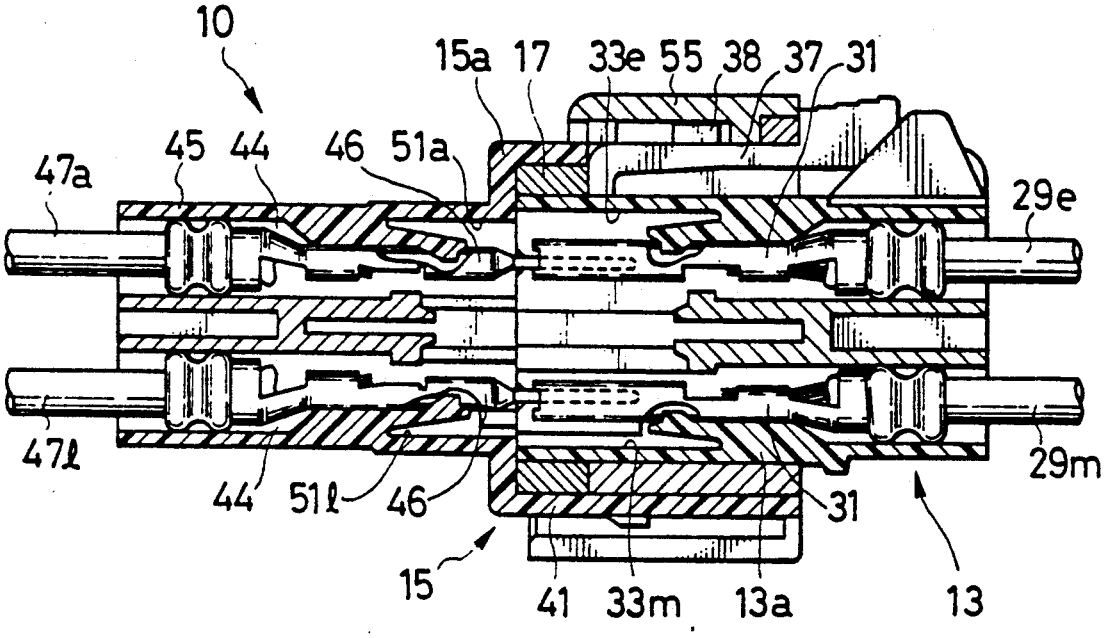
FIG. 6 is another cross sectional view which shows a portion in the connector where the connector is used as an intermediate connector.

Further, as shown in FIG. 6, the female terminals 31 in the intermediate connector section 13a of the male connector member 13 are connected to the male terminals 43 in the intermediate connector section 15a of the female terminal 15, respectively. Therefore, electrical connection is established between each female terminal 31 in the intermediate connector section 13a of the male connector 13 and each male terminal 46 in the intermediate connector section 15a of the female connector member 15 in series. As a result, the wires 29 connected to the female terminals 31 of the intermediate connector section 13a of the male connector member 13 are electrically connected to the wires 47 connected to the female terminals 46 of the intermediate connector section 15a of the female connector member 15 in series, thus providing a function as an intermediate connector.

Figure 7:
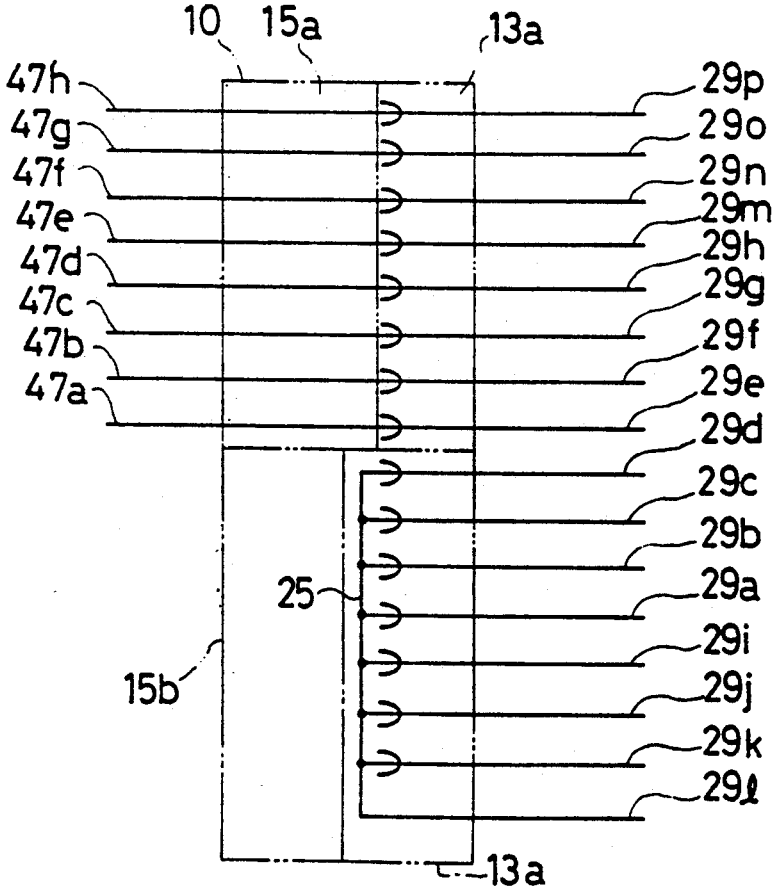
FIG. 7 is a circuit diagram showing a condition that the electrical connector of this embodiment is used.

FIG. 7 is a circuit diagram showing the relationship of the electrical connections among the wires 29, 47 connected to the male and female connector members 13, 15 of the electrical connector according to this embodiment. From the drawing, it will be apparent that the wires 29e, 29f, 29g, 29i, 29m, 29n, 29o and 29p connected to the terminals 31 in the intermediate connector section 13a of the male connector member 13 are connected to the wires 47a, 47b, 47c, 47d, 47e, 47f, 47g and 47h connected to the terminals 46 in the intermediate connector section 15a of the female connector member 15 in series, while the wires 29a, 29b, 29c, 29d, 29i, 29j, 29k and 29l connected to the terminals 31 in the joint connector section 13b of the male connector member 13 are connected in parallel with each other by means of the joint member 25. Therefore, the electrical connector according to this embodiment has functions as an intermediate connector and a joint connector.

The electrical connector according to this embodiment has the above structure and functions. Therefore, if the connector is used in a junction point in wiring where series connection and multiple connection between the wires are required, the requirement can be satisfied by a single connector. Therefore, it becomes possible to reduce number of the connectors used in the wiring, such as a wiring harness used in an automobile. Further, as stated in the above, according to this embodiment, by preparing different joint members each having different number of tabs or arrangement of tabs, it becomes possible to provide different electrical connection in the joint connector sections of the connector. Further, since the connecting member has a very simple structure, the manufacturing cost thereof is quite inexpensive compared with the connecting housing of the conventional joint connector as described above. Therefore, according to the electrical connector of this embodiment, the degree of freedom in designing branch circuits will be remarkably increased with inexpensive cost.

In the above embodiment, wires for a branch circuit are connected only to the joint connector section of the male connector member. However, it is of course possible to design the connector in such a manner that terminals are provided in the joint connector section of the female connector member and no terminals are provided in the joint connector section of the male connector member. Further, if the joint member is removed and then the male and female connectors are fitted together without the joint member, the connector can be used as a mere intermediate connector. Furthermore, it is needless to say that the number and arrangement of the terminals is no limited to those of the embodiment as described above.

In this disclosure, there is shown and described only the preferred embodiment of the present invention, but, as aforementioned, it is capable of making changes or modifications within the scope of the inventive concept as expressed herein.

What is claimed is:

1. An electrical connector, comprising:

a first connector member having first and second sections both including a plurality of electrical terminals therein;

a second connector member adapted to be fitted to the first connector member, the second connector member having a first section including a plurality of electrical terminals therein and a second section including no electrical terminals therein, in which the electrical terminals in the first section of the second connector member are adapted to be connected to the terminals in the first section of the first connector member to establish electrical connection between these terminals when the first and second connector members are fitted together; and a joint member for establishing electrical connection among at least two of the terminals in the second section of the first connector member, the joint member being adapted to be removably fitted to the at least two electrical terminals of the second section of the first connector member and to achieve electrical connection therebetween through the joint member when the joint member is fitted thereto.

2. An electrical connector as claimed in claim 1, wherein the first connector member is formed into a male connector member and the second connector member is formed into a female connector member having a hood portion containing the first and second sections of the second connector member.

3. An electrical connector as claimed in claim 2, wherein the joint member includes at least two electrical contacts which are electrically connected with each other, the at least two contact parts of the joint member are arranged so as to be connected to the terminals in the second section of the male connector member among which electrical connection is desired to establish, when the joint member is fitted to the terminals.

4. An electrical connector as claimed in claim 3, wherein the joint member is designed such that it will be housed in the second section of the female connector member when the connector members are joined together.

* * * * *